US005086630A

United States Patent [19]

Van Steenburgh, Jr.

[11] Patent Number: 5,086,630

[45] Date of Patent: Feb. 11, 1992

[54] REFRIGERANT RECLAIM APPARATUS

[76] Inventor: Leon R. Van Steenburgh, Jr., 1900 S. Quince, Denver, Colo. 80231

[21] Appl. No.: 677,607

[22] Filed: Mar. 27, 1991

Related U.S. Application Data

[60] Division of Ser. No. 309,421, Feb. 10, 1989, abandoned, which is a continuation-in-part of Ser. No. 109,958, Oct. 19, 1987, abandoned.

[51] Int. Cl.[5] ..... F25B 43/04

[52] U.S. Cl. ..... 62/475; 62/470; 62/298; 62/292

[58] Field of Search ..... 62/77, 149, 292, 475, 62/513, 85, 298

[56] References Cited

U.S. PATENT DOCUMENTS 4,476,688 10/1984 Goddard ..... 62/149

4,554,792 11/1985 Margulefsky et al. ..... 62/77

*Primary Examiner*—Henry A. Bennet

*Attorney, Agent, or Firm*—Beaton & Swanson

[57] ABSTRACT

A refrigerant reclaim system including a compressor, a heat exchanger, an oil separator, a condenser, a chill tank, a filter-drier and a cooling coil in the chill tank. Such refrigerant reclaim system including means for evacuating gaseous refrigerant after the removal of all liquid refrigerant, means for accumulating residual oil in the gaseous refrigerant and returning it to the compressor motor, and means for controlling the inlet and outlet systems to prevent flow of refrigerant except when desired.

11 Claims, 2 Drawing Sheets

REFRIGERANT RECLAIM APPARATUS

CROSS-REFERENCE TO RELATED APPLICATIONS

This is a divisional of copending application Ser. No. 07/309,421 filed on Feb. 10, 1989, now abandon which is a continuation-in-part of copending application Ser. No. 109,958 filed Oct. 19, 1987 aband, for "Refrigerant Reclaim Method and Apparatus."

FIELD OF INVENTION

This invention relates to an apparatus for removing refrigerant from a refrigeration system during repairs, confining it so as to avoid its escape to the atmosphere, separating contaminants from the refrigerant and returning the refrigerant to the repaired refrigeration system or discharging it to a storage container.

BACKGROUND OF THE INVENTION

In the past, little attention was paid to the storage or recycling of refrigerant. When refrigeration systems were being repaired or when the refrigerant, such as those sold under the trademark "Freon," was contaminated sufficiently to affect the effectiveness of refrigeration, the refrigerant was vented into the atmosphere.

Recent developments have, however, created a demand for systems capable of storing refrigerant while at the same time purifying the contaminated refrigerant. The United States, as have several other countries, has become a signatory of the "Montreal Protocol on Substances that Deplete the Ozone Layer", which restricts future productions of fully halogenated chlorofluorocarbons. Pursuant to this international mandate, future production of all currently used refrigerants are to be drastically cut by the end of the century. In addition to this development, the United States Environmental Protection Agency has classified several widely used refrigerants as hazardous substances under the Resource Conservation and Recovery Act ("RCRA").

The combination of these two regulatory developments accentuates the necessity for a device which will store and purify refrigerant, eliminating the possibility of unlawful emissions and the necessity for purchasing refrigerants in an artificially constrained market. The present invention relates to improvements on the refrigerant reclaim method and apparatus as described in co-pending U.S. application Ser. No. 109,958 of Van Steenburgh, Jr.

Patent application Ser. No. 109,958, discloses an apparatus for drawing refrigerant from a container, or a refrigeration system to be repaired, heating the refrigerant sufficiently to maintain it in a gaseous state while it passes through an oil separator into the intake of a compressor. Compressed gaseous refrigerant is discharged from the compressor and passed through a heat exchanger to heat the incoming liquid refrigerant and then passes through to a condenser where it is liquefied. The liquefied refrigerant is passed from the condenser into a hold tank from the bottom of which liquid refrigerant flows through a filter-dryer and an expansion device for reconverting the liquid refrigerant to a gaseous form. From the expansion device the gaseous refrigerant passes through a coil submerged in the liquid in the hold tank and then is passed back to the intake of the compressor. The temperature of the liquid in the hold tank is lowered by the chilling effect of the expanding gaseous refrigerant passing through the coil submerged in the liquid. The refrigerant can be repeatedly passed from the chill tank through the filter-dryer, expansion device, cooling coil, compressor, heat exchanger, condenser and back to the hold tank. This repeated process will progressively lower the temperature of refrigerant in the hold tank, pass the refrigerant through the filter-dryer repeatedly, and, by lowering the temperature of the refrigerant, maximize the separation of air from the refrigerant.

The apparatus described in application Ser. No. 109,958 provides several advantages over the prior art. There are, however, several additional attributes that are desirable in refrigerant reclaim systems.

One of the major deficiencies in the apparatus described in application Ser. No. 109,958, as well as in other refrigerant reclaim devices, is in the removal and reclamation of various refrigerants. U.S. application Ser. No. 258,166, also a continuation-in-part of application Ser. No. 109,958, describes means for utilizing the refrigerant reclaim system with a plurality of different refrigerants. Because of the different physical properties of different refrigerants, it is necessary to utilize different expansion valves for each refrigerant. Application Ser. No. 258,166 describes an apparatus for switching different expansion valves on-line based on the particular refrigerant being reclaimed.

Along with the great advantages of being able to use a single reclamation unit for several different refrigerants, is an associated problem. After discharging liquefied and chilled refrigerant from the chill-tanks of the reclaim unit, the system still contains a significant amount of refrigerant vapor. This vapor can be at a pressure from 80 to 150 psi and can total 2 to 8 pounds of refrigerant. When the next refrigeration system to be reclaimed contains the same refrigerant, the vapor can be left in the reclaim unit. However, when a different refrigerant is to be reclaimed, the refrigerant vapor must be removed from the system. It is very important that different refrigerants not be mixed together.

The traditional response to such a problem would be to vent the refrigerant to the atmosphere. Unfortunately, as described above, the venting of relatively significant amounts of refrigerant is no longer a viable alternative. In the device disclosed in application Ser. No. 109,958, venting is accomplished by opening both the inlet and outlet valves and letting the refrigerant escape from the different sections of the system. Opening just the inlet or outlet would not allow all the gaseous refrigerant to be released. Means for quickly removing residual refrigerant vapor from the reclaim unit are quite necessary and currently unavailable in existing reclaim systems.

An additional problem with the refrigeration reclaim system described in application Ser. No. 109,958 is in the maintenance of the compressor motor. Application Ser. No. 258,166 describes means for cooling the motor windings and for monitoring crankcase oil levels.

During long term use of the refrigerant reclaim system of application Ser. No. 109,958, it is clear that the vast majority of oil entering the reclaim system with the refrigerant is separated out in the oil separator. Some residual oil is still seen in the refrigerant even after several passes through the evaporation/condensation process. The presence of small residual amounts of oil in the refrigerant is predominantly attributable to the gradual loss of oil from the crankcase of the compressor. It is, therefore, desirable to find some means of removing the residual oil from the refrigerant and returning it to the compressor.

A final problem associated with all refrigeration reclaim systems is the design of high pressure seals at the systems inlet and outlet ports. For example, at the refrigerant inlet port, it is necessary to have a seal or valve that will allow refrigerant to flow into the system from a high pressure source. At the same time, the seal or valve must be capable of preventing the loss of high pressure refrigerant from within the system. The opposite set of circumstances causes a similar problem at the outlet of the system. The problem with solving what sounds like a relatively simple problem, is that there is no commercially available refrigeration valve capable of stopping flow in two directions when closed.

SUMMARY OF THE INVENTION

The present invention provides means for drawing refrigerant from a container and removing oil, water and other contaminants. This invention specifically relates to an improved apparatus for the reclamation of refrigerant. In particular, this invention describes means for simply and quickly evacuating refrigerant vapor from the system after the condensed refrigerant has been discharged from the system. The vapor evacuation means provide the user a route for purging a refrigerant from the system that is nearly as simple and quick as purging the vapor to the atmosphere. Such a process not only resolves the environmental problem of venting refrigerant to the atmosphere, but over the long term can save significant amounts of refrigerant that would otherwise have to be purchased.

This invention also relates to a refrigeration reclaim system having means for accumulating residual amounts of oil from the reclaimed refrigerant and returning it to the crankcase of the compressor motor in a usable form. Such means also provide additional protection against the inadvertent introduction of liquid refrigerant into the compressor. Finally, this invention describes refrigerant inlet and outlet devices capable of properly introducing or discharging refrigerant from the system while also prohibiting the introduction or loss of refrigerant when not in use or before desired.

The invention can be more fully understood when the detailed description which follows is read with reference to the accompanying drawings.

DRAWINGS

DETAILED DESCRIPTION

Figure 1:
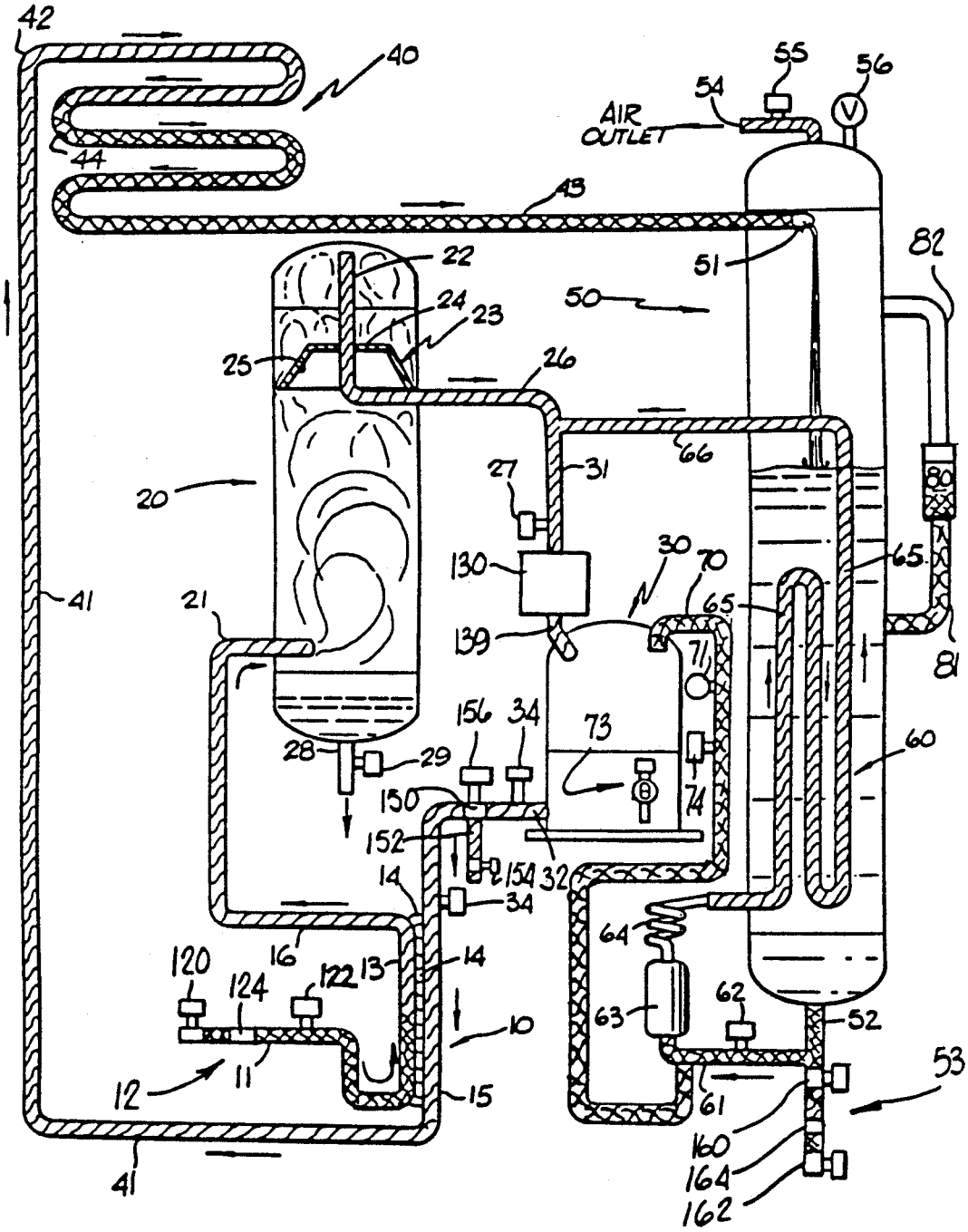
FIG. 1 is a schematic illustration of the invention in which the parts illustrated are either standard items which can be purchased or are disclosed in sufficient detail when viewed in conjunction with the description.

As illustrated in FIG. 1, the reclaim system of this invention includes a heat exchanger 10, one portion of which is in fluid communication with a refrigerant intake fluid conduit 11. The conduit 11 is in fluid communication with conduit 13 which constitutes the cold side of heat exchanger 10.

The inlet system 12 controlling the introduction of refrigerant into the reclaim system consists of inlet solenoid valves 120 and 122 and viewing window 124. Inlet solenoid valve 120 allows flow of refrigerant to proceed in either direction when switched on. When switched off, valve 120 will prevent the flow of refrigerant through fluid conduit 11 out of the reclaim system. Inlet solenoid 122 also allows flow of refrigerant to proceed in either direction when switched on. When switched off, valve 122 will prevent the flow of refrigerant through fluid conduit 11 into the reclaim system. Viewing window 124 is a part of conduit 11 between inlet solenoid valves 120 and 122. Through viewing window 124 the operator of the refrigerant reclaim system is able to observe the flow of refrigerant into the system.

The inlet system 12 enables the use of standard refrigerant solenoid valves commonly available and known in the prior art. Such standard solenoid valves are designed to prevent flow of refrigerant only in one direction when in the off position. By placing two solenoids, allowing flow in opposing directions, it is possible to use commercially available refrigerant solenoid valves to charge refrigerant into the reclaim system only when the solenoids are on and to assure that there wil be no loss of refrigerant from the system.

Conduit 16 constitutes the outlet from the cold side of heat exchanger 10 and is in fluid communication with oil separator 20 through the conduit 21. The fluid conduit 21 extends through the outer wall of the oil separator tank 20 somewhat above the lower end of the tank and extends inwardly so that its open end is near the axis of the tank. Another fluid conduit 22 has its open end fixed near the inner surface of the rounded top of the tank. This fluid conduit extends downwardly and supports a circular baffle 23 composed of a disc-like portion 24 and a downwardly extending partially cone-shaped skirt 25. Conduit 22 is arranged to extend along the axis of the tank and is connected to fluid conduits 26 and 31 controlled by a low pressure activated electrical control device 27 having a pressure gauge indicator associated with it. The control 27 will automatically shut down compressor 30 when the pressure in conduit 31 drops to virtually zero PSIG.

Figure 2:
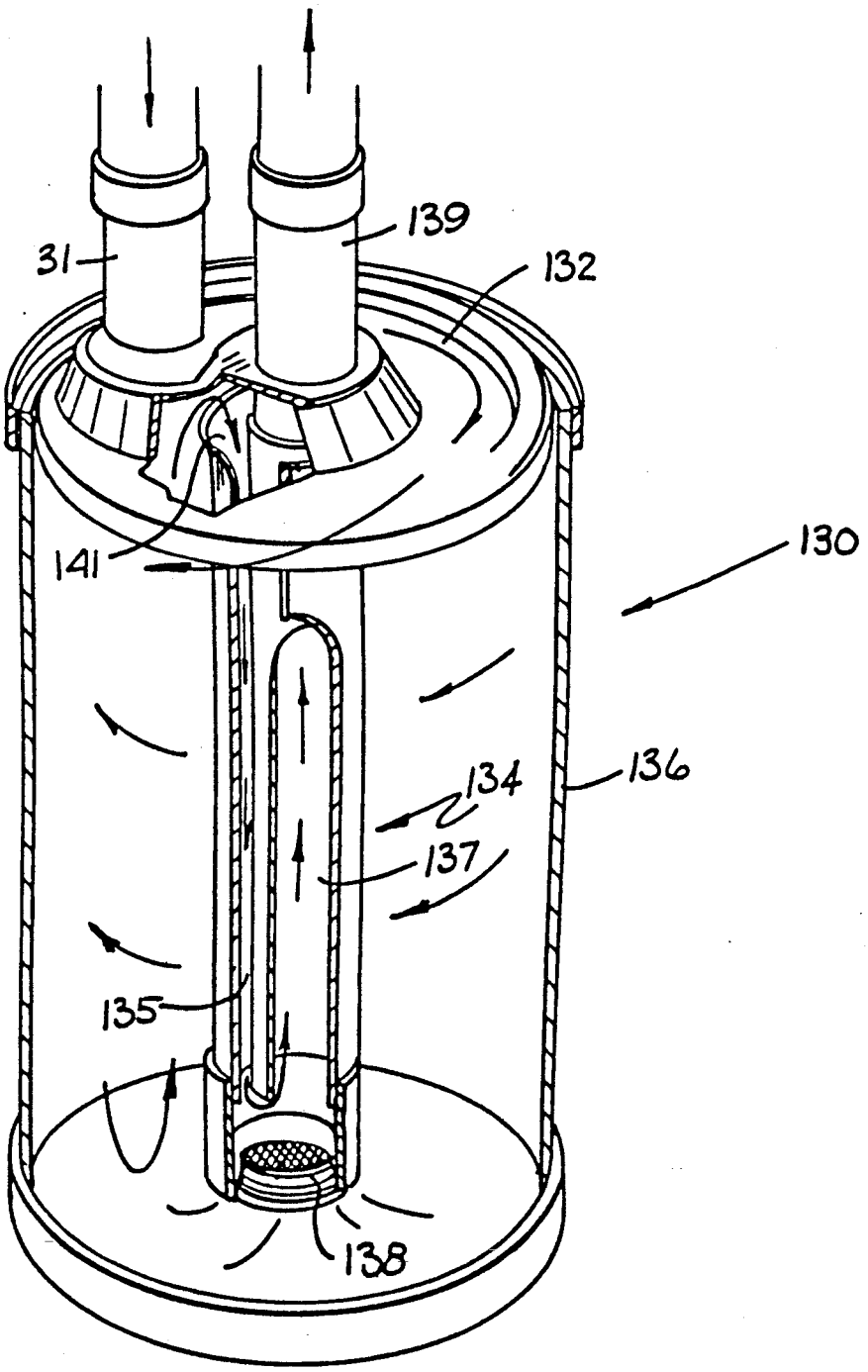
FIG. 2 is a view of an embodiment of the oil accumulator device used for collecting oil mist from refrigerant vapor and returning it to the compressor motor.

Fluid conduit 31 is in fluid communication with oil accumulator 130. Oil accumulator 130, seen in more detail in FIG. 2., consists of a cylindrical canister 136, a directional gutter 132, a bifurcated tube 134 and a liquid collection reservoir 138. Fluid conduit 31 extends through the top of the outer wall of oil accumulator 130. The interior of the oil accumulator 130 is in fluid communication with fluid conduit 139 via the bifurcated tube 134.

The bifurcated tube 134 consists of an outer chamber 135 and an inner chamber 137 in fluid communication with each other. The outer chamber has an opening 141 into the interior of the canister 136. The bifurcated tube 134 is in fluid communication with the collection reservoir 138 at the bottom of the canister 136.

Fluid conduit 139 extends through the outer wall of compressor 30 and a short distance into its interior. Fluid conduit 70 also extends through the outer wall of compressor 30 and a short distance into its interior. Conduits 139 and 70 are designed to release refrigerant onto the electrical coils found within the compressor 30. Flow through conduit 70 into the compressor 30 is controlled by a low pressure activated electrical control device 71 and solenoid valve 74. The control device 71 is located so that it will open and permit liquid refrigerant to flow into the compressor 30 when solenoid valve 74 has been opened and the pressure within the compressor 30 drops to a preset level.

Compressor 30 is provided with an oil sight gauge 73 and oil supply device 33. Outlet conduit 32 has a high pressure activated electrical control device 34 associated with it and is in fluid communication with vapor out valve 150. Vapor out valve 150 is in fluid communication with fluid conduit 15 and vapor outlet conduit 152. Vapor outlet conduit 152 is equipped with a check valve 154 that prevents any flow of refrigerant into the system via vapor out valve 150. Vapor outlet valve 150 is controlled by a solenoid 156. When power is supplied to the solenoid, outlet conduit 32 is only in fluid communication with fluid conduit 15. When vapor outlet valve 150 solenoid is off, outlet conduit 32 is only in fluid communication with vapor outlet conduit 152. Conduit 15 of heat exchanger 10 is in fluid communication with conduit 41, which in turn is in fluid communication with a condenser 40 through condenser inlet conduit 42. If pressure in conduit 32 is too high, control 34 acts automatically to shut down compressor 30.

Outlet conduit 43 connects condenser 40 in fluid communication with chill tank 50, which as illustrated is an elongated, cylindrical pressure tank arranged with its longitudinal axis extending vertically and having upper and lower ends of partially spherical shape. Outlet end 51 of fluid conduit 43 is located substantially on the axis of chill tank 50. At the bottom of the chill tank 50 there is a fluid conduit 52 controlled by solenoid valve 53 and arranged in fluid communication with the interior of chill tank 50. At the upper end of chill tank 50 there is an air outlet conduit 54 controlled by solenoid valve 55 having a pressure gauge indicator associated with it. Also located at the upper end of chill tank 50 is a high pressure activated safety valve.

Chill tank 50 is also provided with a float control 80. The float control 80 is in fluid communication with chill tank 50 via conduits 81 and 82. Conduit 82 is attached to the top of the float control 80 and enters the chill tank 50 at a point located somewhat below the upper end of the tank. Conduit 81 is attached to the bottom of float control 80 and enters the chill tank 50 at a point located approximately near the point midway between the upper and lower ends of the tank.

The float control 80 is located at a point outside of and next to the chill tank 50 at approximately the maximum level to which the chill tank may safely be filled with liquid refrigerant. As the level of liquid refrigerant in the chill tank 50 raises to a point above the place where conduit 81 enters the tank, the level of refrigerant within conduit 81 will be at substantially the same height as the level in the chill tank. When the level of liquid refrigerant in the chill tank 50 is at approximately the same height that the float control 80 is at, the float control will be activated and the inlet solenoid valve 12 will automatically shut. If refrigerant is removed from the chill tank 50 and the level of refrigerant in the tank falls below the height of the flow control, the inlet solenoid valve 12 shut-off will be deactivated.

Located partially within and partially outside chill tank 50 is a cooling and recycling system 60 composed of a conduit 61 in fluid communication with conduit 52 and controlled by solenoid valve 62. The fluid conduit 61 is in fluid communication with filter-dryer 63, which in turn is connected in fluid communication with expansion means 64. Fluid conduit 61 is also in fluid communication with inlet conduit 70 of compressor 30. Expansion means 64 is in fluid communication with conduit 65 arranged in the form of a coil within the chill tank 50. The cooling coil 65 is in fluid communication with conduit 66, which is in turn in fluid communication with inlet conduit 31.

The refrigerant outlet for the system is via fluid conduit 52 and is controlled by outlet system 53. Outlet system 53 consists of outlet solenoid valves 160 and 162 and sight window 164. Outlet solenoid valve 160 allows flow of refrigerant to proceed in either direction when on. When switched off, valve 160 will prevent flow of refrigerant through conduit 52 out of the reclaim system. Outlet solenoid valve 162 allows flow of refrigerant to proceed in either direction when on. When switched off, valve 162 will prevent flow of refrigerant through conduit 52 into the reclaim system.

All the elements of the reclaim system of this invention can be mounted within a mobile cabinet (not shown) having a control panel in one outer surface and casters underneath it.

The control panel includes a power on-off switch which, depending on the positions of various valves and the pressures at various points in the system, energizes the compressor 30 and the valves 120, 122, 29, 55, 160, 162 and 62. Since controls 27 and 34 shut down or start up compressor 30 automatically when the power is on, and since relief valve 56 responds automatically to pressure, the control panel need not include switches for manually activating these devices.

The control panel includes a "vapor" on-off switch which activates the solenoid valve 74. When the vapor switch is turned on solenoid valve 74 is opened, and the low pressure activated control 71 is capable of allowing controlled amounts of liquid refrigerant to enter into the compressor 30 via intake conduit 70 when the pressure in compressor 30 drops below a predetermined level.

The control panel also has a "vapor out" switch which turns off power to vapor out valve 150, and a "compressor on" switch which overrides all automatic compressor switch offs and directly supplies power to the compressor 30. Both the "vapor out" and "compressor on" switches are pressure activated and can not be kept in the on position without being continually held on by the operator.

In addition to these controls, the control panel needs only the following additional controls: (1) a switch that activates both valves 120 and 122 (refrigerant in), (2) a switch for valve 29 (oil out), (3) a switch that activates both valves 160 and 162 (refrigerant out), (4) a switch for valve 55 (air out), and (5) a switch for valve 62 (control for cooling and recycling system 60). The control panel also includes two pressure gauge indicators, one for displaying the pressure entering conduit 31 and the other for displaying the pressure at valve 55 and the upper portion of chill tank 50. Details of the circuitry for electrically connecting switches, controls, valves and gauges will be apparent to those skilled in this art.

In a preferred embodiment of the invention, chill tank 50, being the largest element of the reclaim system, and being about 48 inches in height, the cabinet should be about 62 inches in height including the height of the casters. The cabinet can be about 28 inches in width and 24 inches in depth if the cabinet contains the system illustrated in the drawing which has only one chill tank 50. Depending on the anticipated use of the reclaim system, the chill tank 50 can be of almost any size. Preferably, the chill tank is capable of storing between 25 and 50 pounds of refrigerant.

As will be apparent to those skilled in the art, if the cooling effect from one chill tank 50 is insufficient, or if additional refrigerant storage capacity is required, one or more additional chill tanks can be provided and connected to run in parallel with the first chill tank 50. In one preferred embodiment, each chill tank is about 6 inches in diameter, has a capacity to store or hold 45 lbs. of refrigerant such as R-12, R-22, R-502 or R-500 and meets ASME and Underwriters Laboratory specifications for pressure tanks. The tank for oil separator 20 preferably meets the same specifications and is 36 inches long and 6 inches in diameter. The following is a compilation of the items which are standard devices which can be purchased, together with an identification of these items:

| Item Description No. | Manufacturer | Identification No. |
|---|---|---|
| Compressor 30 | Copeland Corp. | SSC4-0200 |
| Condenser 40 | Snow Coil Co. | 5858M786 |
| Heat Exchanger 10 | Packless Industries | AES001672 |
| Control 34 | Ranco, Inc. | 016-42 |
| Control 27 | Penn Corp. | P70AB-2 |
| Solenoid Valves 62, 55, 29, 74, 120, 122, 160, 162 | Sporelan Valve Co. | E35-130 |
| Safety Valve 56 | Superior | 3014-400 |
| Gauges on control panel | Ashcroft | Laboratory quality 1377-AS |
| Filter-Drier 63 | Sporelan Valve Co. | 384 cubic in. |
| Float control 80 | Watsco, Inc. | RLM-1 |
| Expansion Device 63 | Sporelan Valve Co. | |
| Oil Accumulator 130 | Tecumseh Prod. Co. | TK |
| Vapor out Valve 150 | Sporelan Valve Co. | MKC-1 |

A unit constructed as disclosed above weighs about 325 lbs.

When the system illustrated is utilized in repair of the refrigerating systems of an air conditioner, for example, fluid conduit 11 is connected to a refrigerant outlet in the refrigeration system, the power is turned on and valves 120 and 122 are opened, FIG. 1. Because of the dual arrangement of solenoid valves 120 and 122, after attaching a source of high pressure refrigerant to inlet conduit 11, refrigerant will not enter the reclaim until both solenoid valves are opened. If only the inlet solenoid valve 120 were present, refrigerant would be prevented from escaping the system, but a high pressure source attached at the inlet conduit 11 would flow into the system. Valves capable of being totally open to flow when open, and preventing flow in both directions when closed are not commercially available.

Control 27 at the inlet to the compressor is activated when it senses pressure in fluid conduit 31, and with the power turned on, compressor 30 begins to function. Refrigerant from the refrigeration system is drawn into the reclaim system through conduit 11. Normally the refrigerant at this point will be liquid, which has been illustrated in the drawings by double cross-hatching inside the fluid conduit. When withdrawing liquid from the refrigeration system, the "vapor" switch should be in the off position. At some point in fluid conduit 13 of heat exchanger 10 the refrigerant is converted to gaseous form by the heat transferred to it from conduit 15 carrying the output of compressor 30. The single cross-hatching in fluid conduit 13 is illustrative of refrigerant in gaseous form. Through FIG. 1 double cross-hatching indicates liquid and single cross-hatching gas or vapor. The refrigerant flows through fluid conduits 16 and 21 into oil separator 20. The refrigerant is relatively hot at this point and is an expanding gas rising rapidly within the tank of the oil separator 20. The upward flow of gas is abruptly interrupted by the baffle 23 causing oil to be separated and to drop to the bottom of the tank. The gaseous refrigerant passes around the outer (lower) edge of skirt 25 which is spaced from the interior wall of the surrounding tank by an amount providing a total open area which is approximately equal to the open area at the upper end of conduit 22. The gaseous refrigerant passes around skirt 25 into the upper end of fluid conduit 22, then through fluid conduit 26 into fluid conduit 31.

So long as there is sufficient pressure in the fluid conduit 31 to indicate that the refrigeration system of the air conditioner has not been completely evacuated, compressor 30 will continue to run. When all of the liquid refrigerant has been removed and only some gaseous refrigerant remains or only gaseous refrigerant is being reclaimed, the vapor switch should be in the on position. When the vapor switch has been turned on, solenoid valve 74 is opened and liquid refrigerant in conduit 70 may enter compressor 30 as allowed by low pressure activated control 71. The liquid injection cooling system, whereby controlled amounts of liquid refrigerant are directly released into the compressor 30 at inlet conduit 70 will only occur when the pressure in the compressor 70 indicates that there is not sufficient amounts of gaseous refrigerant in the system to assure adequate cooling of the compressor motor.

Refrigerant in fluid conduit 31 enters the oil accumulator 130. The hot refrigerant vapor is forced to circulate around the interior of the accumulator canister 136 by the directional gutter 132. The rotational motion of the refrigerant causes substantially all of the oil droplets and mist and any liquid refrigerant to adhere to the interior walls of the canister 136. The liquid oil and refrigerant flows to the bottom of the canister 136 and collects in the liquid collection reservoir 138. The gaseous refrigerant enters the outer chamber 135 of the bifurcated tube 134 via the opening 141 and flows downwardly past the liquid collection reservoir 138 and into the inner chamber 137 of the bifurcated tube 134. The gaseous refrigerant then rises and exits the oil accumulator via fluid conduit 139.

The vast majority of oil entering the reclaim system with the refrigerant to be reclaimed is removed in the oil separator 20. The major source of oil in the refrigerant that has already passed through the oil separator is from the compressor motor. When in the chill mode refrigerant is continuously expanded, compressed and condensed. During this process oil is continuously leaving the compressor as a fine mist in the refrigerant. When passed through the compressor the oil mist in the refrigerant is compressed along with the refrigerant and does not replenish the oil in the compressor crankcase.

The oil accumulator 130 provides means for condensing and concentrating the oil mist in the refrigerant. When a certain equilibrium amount of oil has accumulated in the liquid collection reservoir 138, the gaseous refrigerant carries a stream of oil with it into the compressor 30 via conduit 139. The stream of oil, unlike a mist, will not simply be compressed and be passed out of the compressor along with the refrigerant, but will migrate to the motor crankcase and restore lost oil to the compressor 30.

The oil accumulator 130 also acts as a safeguard against the possibility of liquid refrigerant entering the compressor to cause "liquid slugging." Although the reclaim system is designed to prevent the possibility of liquid slugging, an additional safeguard is valuable to protect the compressor from the destructive effects of liquid slugging.

Refrigerant from fluid conduit 139 passes into the compressor 30, is compressed and discharged through fluid conduit 32 and passes through vapor out valve 150 and the heat exchanger in fluid conduit 15 and then through fluid conduit 41 into condenser 40 through condenser inlet 42. The gaseous refrigerant entering the condenser is converted into a liquid at some point in the condenser such as 44.

Liquid refrigerant passes out of the condenser 40 into conduit 43 and through that conduit into the upper portion of chill tank 50. At this point, valves 160 and 162 and 62 are closed and the compressor will continue to withdraw refrigerant from the refrigeration system of the air conditioner, and to cause liquid refrigerant to be discharged into chill tank 50 until the pressure at the inlet to compressor 30 drops to virtually zero PSIG indicating all of the refrigerant has been removed from the refrigeration system of the air conditioner. At this point, control 27 will act to shut down compressor 30. When the vapor switch is on, the liquid injection of refrigerant will provide enough pressure in the compressor 30 to prevent control 27 from shutting down the compressor. When the source pressure and the system pressure are both the same, the vapor switch may be turned off and the system will quickly evacuate all traces of refrigerant and the compressor will shut off before any compressor overheating can occur.

In the situation where the refrigeration system being drained of refrigerant holds more refrigerant than the chill tank 50 can safely hold, the compressor 30 will be automatically shut down when the float control 80 indicates that the chill tank's capacity has been reached and the inlet solenoid valve 12 is shut.

After all of the refrigerant has been removed from the refrigeration system, the operator will close valves 120 and 122 (refrigerant intake) and open valve 62 causing liquid refrigerant to leave the chill tank 50 through fluid conduit 52 and into filter dryer 63 through fluid conduit 61. If solenoid valve 74 and low pressure activated control 71 are open, a controlled amount of liquid refrigerant may be directed through conduit 71 into the compressor 30. The liquid refrigerant then passes through the expansion means 64 where it is converted into a gas and passes through coil 65 to cool the liquid refrigerant, illustrated in the drawing as filling approximately ¾ of chill tank 50 and having the coil 65 submerged in it. When expanding gas from coil 65 reaches the compressor inlet conduit 31 via fluid conduit 66, there will be sufficient pressure to actuate control 27, and the compressor will automatically start running again.

When valves 120 and 122 are closed, the cold side of the heat exchanger 10 and the entirety of oil separator 20 are shut down. With pressure in fluid conduit 31, the compressor continues to operate and the gaseous refrigerant passes through the oil accumulator 130 and enters the compressor through conduit 139 and is compressed and discharged from the compressor through fluid conduit 32 and thence through the heat exchanger 10 and condenser 40 back into the chill tank 50. The cycle just described is repeated continuously until the temperature of the liquid refrigerant in chill tank 50 has been reduced to the desired level, normally about 38 to 45 degrees Fahrenheit.

The repeated passing of liquid refrigerant through filter dryer 63 removes substantially all acid and water from the liquid refrigerant. During this recycling, normally a certain amount of air will also be separated from the refrigerant and accumulated in the upper portion of chill tank 50, causing the pressure to rise in the chill tank 50. Air may be removed from the reclaim system by opening valve 55 so that the air escapes through conduit 54. This is normally done when the pressure within the chill tank 50 reaches something in excess of 300 PSIG and is accomplished by activating a switch on the control panel. In the unlikely event that pressure in the chill tank 50 should reach a level of about 325 PSIG, safety valve 56 will be actuated and gases in the system will be vented. Preferably, there is an additional control for releasing gaseous contents of the chill tank 50 into the atmosphere should the pressure in the tank reach a level of about 400 PSIG. Such control may take the form of a pressure sensitive spring loaded ball bearing. Of course, the action of the float control 80 will generally prohibit filling of the chill tank 50 to a level that would require use of the back up safety devices for relieving excess pressure in the chill tank.

Before any liquid refrigerant is returned to the vessel from which it was removed, which is done by closing valve 62 and opening valves 160 and 162, any oil which has been collected in the bottom of oil separator 20, as schematically illustrated in the drawing, should be removed from the oil separator 20 through outlet 28 by opening valve 29. The amount of oil removed should be measured so that an appropriate amount of oil can be resupplied to the refrigeration system.

Liquid refrigerant is removed from the reclaim system via outlet system 53. A refrigeration system or a storage cylinder is attached to outlet conduit 52. Opening outlet solenoid valves 160 and 162 permits the cooled refrigerant to exit the reclaim system and flow into the storage cylinder.

After discharging the liquid refrigerant from the chill tank 50, the system may contain from two to eight pounds of gaseous refrigerant at a pressure from 50 to 150 p.s.i. To remove the pressurized vapor from the reclaim system, an empty cylinder is attached to the vapor outlet conduit 152. Preferably, a 125 pound cylinder is used. All switches on the reclaim are turned off and the "vapor out" and "compressor on" switches are simultaneously depressed. All of the gaseous refrigerant in the reclaim system is drawn to and through the compressor 30 and into the vapor out valve 156, where it is directed through vapor outlet conduit 152 into the cylinder. The two switches are to be depressed until both pressure gauges on the panel indicate that the system is at atmospheric pressure. Residual amounts of gaseous refrigerant can be removed by a vacuum pump. In order to speed up the evacuation process, a conduit (not shown) may be connected between inlet conduit 11 and outlet conduit 52 and inlet solenoid valves 120 and 122 and outlet solenoid valves 160 and 162 opened.

The refrigerant reclaim system of this invention may also be utilized to transfer refrigerant from one container to another. This is accomplished by connecting the fluid conduit 11 to the container from which refrigerant is to be taken (the first container) and fluid conduit 52 to the receiving or second container. Upon opening valves 120 and 122 and supplying power to compressor 30, refrigerant will be removed from the first container and passed through heat exchanger 10, the oil remover 20, the oil accumulator 130, the compressor 30, the condenser 40, and into chill tank 50. Operation is continued in this mode until the pressure display on the control panel indicates the first container has been evacuated. As in the other operations, when all of the refrigerant has been removed from the first container, pressure in line 31 will drop to virtually zero PSIG, thus activating control 27 and shutting off the compressor which will not begin to run again until there is pressure in line 31 from the gaseous refrigerant exiting from the cooling device 60. When the final amounts of refrigerant in the first container is vapor, the vapor switch should be turned on, thus activating the liquid injection system by opening solenoid valve 74. When the first container is totally evacuated the vapor switch is turned off and valves 120 and 122 are then closed. Since it will facilitate discharging the refrigerant into the second container, it is desirable that valves 160 and 162 first be closed and valve 62 opened so that cooling device 60 will be operative. Operation in this mode is continued for a sufficient period to reduce the liquid refrigerant in chill tank 50 to the desired temperature. When the desired temperature is reached, valve 62 is closed, valves 160 and 162 are opened, and liquid refrigerant will flow from the chill tank 50 into the receiving container by gravity, and any pressure from gases in the upper portion of chill tank 50.

I claim:

1. An apparatus for reclaiming refrigerant comprising, in combination, cleaning means for removing gaseous or liquid refrigerant from a container, vaporizing all of said liquid refrigerant and separating oil from the gaseous refrigerant, a compressor for receiving and compressing said gaseous refrigerant from said container, a condenser for receiving and condensing said gaseous refrigerant from said compressor, storing means for receiving and storing said liquid refrigerant from said condenser, removal means for removing condensed refrigerant out from said storing means, and evacuations means for evacuating high pressure gaseous refrigerant from the entire apparatus after all of said condensed refrigerant has been removed said storing means; said evacuation means comprised of the three-way solenoid valve and an operator activated switch functionally associated with said solenoid valve wherein the activation of said switch causes said evacuation of high pressure gaseous refrigerant; and said evacuation means located adjacent to and in fluid communication with the exit of said compressor.

2. The apparatus of claim 1 wherein said evacuation means is further comprised of means for enabling fluid communication between said cleaning means and said removal means.

3. An apparatus for reclaiming refrigerant comprising, in combination, cleaning means for removing gaseous or liquid refrigerant from a container, vaporizing all of said liquid refrigerant and separating oil from the gaseous refrigerant, a compressor for receiving and compressing said gaseous refrigerant from said container, a condenser for receiving and condensing said gaseous refrigerant from said compressor, means for receiving and storing said liquid refrigerant from said condenser, and valve means for the introduction of refrigerant into said cleaning means comprised of first and second solenoid valves, said first solenoid valve preventing flow out of said inlet means when closed, and said second solenoid valve preventing flow into said cleaning means when closed.

4. The apparatus of claim 3 wherein said valve means is further comprised of sight glass means for viewing the refrigerant located between and in fluid communication with said first and second solenoid valves.

5. The apparatus of claim 3 wherein said first and second solenoid valves are operatively associated with an operator-activated switch, said switch activating both first and second solenoid valves and allowing refrigerant to enter into said cleaning means.

6. An apparatus for reclaiming refrigerant comprising, in combination, means for removing gaseous or liquid refrigerant from a container, vaporizing all of said liquid refrigerant and separating oil from the gaseous refrigerant, a compressor for receiving and compressing said gaseous refrigerant from said container, a condenser for receiving and condensing said gaseous refrigerant from said compressor, storing means for receiving and storing said liquid refrigerant from said condenser, and valve means for the removal of condensed refrigerant from said storing means comprised of first and second solenoid valves, said first solenoid valve preventing flow out of said storage means when closed, and said second solenoid valve preventing flow into said storage means when closed.

7. The apparatus of claim 6 wherein said valve means is further comprised of sight glass means for viewing the refrigerant located between and in fluid communication with said first and second solenoid valves.

8. The apparatus of claim 6 wherein said first and second solenoid valves are operatively associated with an operator-activated switch, and switch activating both first and second solenoid valves and allowing refrigerant to flow out of said storage means.

9. An apparatus for reclaiming refrigerant comprising, in combination, means for removing gaseous or liquid refrigerant from a container, vaporizing all of said liquid refrigerant and separating oil from the gaseous refrigerant, oil accumulator means for receiving and removing oil mist and any liquid refrigerant from said gaseous refrigerant from said container, a compressor for receiving and compressing said gaseous refrigerant from said oil accumulator means, a condenser for receiving and condensing said gaseous refrigerant from said compressor, and means for receiving and storing said liquid refrigerant from said condenser; said oil accumulator means is comprised of a canister containing a directional gutter, of liquid collection reservoir, and a bifurcated tube, whereby said gaseous refrigerant from said container is caused to circulate within said canister by said directional gutter, oil mist accumulates in said liquid collection reservoir, and gaseous refrigerant exits said oil accumulator means via said bifurcated tube.

10. An apparatus for reclaiming refrigerant that has cleaning means for holding refrigerant within the apparatus while repeatedly cleaning and cooling the refrigerant, said cleaning means comprising, oil accumulator means for removing oil mist and any liquid refrigerant from gaseous refrigerant, a compressor for receiving, compressing and discharging gaseous refrigerant from said oil accumulator means, means for condensing the gaseous refrigerant to a liquid, means for conducting the liquid refrigerant into a closed chill tank, means for withdrawing the liquid refrigerant from said chill tank and passing it successively through a filter-drier, means for expanding the refrigerant into a gaseous state, and a fluid conduit within the chill tank extending upwardly from the lower portion of the chill tank, and means outside the chill tank for connecting said fluid conduit in fluid communication with the intake of said oil accumulator means.

11. The apparatus of claim 10 wherein said oil accumulator means is comprised of a canister containing a directional gutter, a liquid collection reservoir, and a bifurcated tube, whereby said gaseous refrigerant from said container is caused to circulate within said canister by said directional gutter, oil mist accumulates in said liquid collection reservoir, and gaseous refrigerant exits said oil accumulator means via said bifurcated tube.

* * * * *